US006085969A

United States Patent [19]

Burgoyne

[11] Patent Number: 6,085,969

[45] Date of Patent: Jul. 11, 2000

[54] PAPERBOARD CARTON AND BLANK THEREFOR

[75] Inventor: Michel Burgoyne, Chateauguay, Canada

[73] Assignee: Labatt Brewing Company Limited, London, Canada

[21] Appl. No.: 09/333,267

[22] Filed: Jun. 15, 1999

Related U.S. Application Data

[60] Provisional application No. 60/089,981, Sep. 19, 1998.

[51] Int. Cl.[7] ..... B65D 5/00

[52] U.S. Cl. ..... 229/109; 206/427; 229/117.17

[58] Field of Search ..... 229/109, 117.16, 229/117.17, 182.1; 206/427

[56] References Cited

U.S. PATENT DOCUMENTS

| | | | |
|---|---|---|---|
| 3,807,624 | 4/1974 | Funkhouser | 206/427 |
| 4,225,078 | 9/1980 | Croley | 229/109 |
| 4,367,840 | 1/1983 | McFadden . | |
| 5,072,876 | 12/1991 | Wilson | 206/427 |
| 5,350,109 | 9/1994 | Brown et al. | 229/117.16 |
| 5,395,043 | 3/1995 | Bacques et al. | 229/109 |
| 5,669,500 | 9/1997 | Sutherland | 206/427 |
| 5,704,470 | 1/1998 | Sutherland | 206/427 |

*Primary Examiner*—Gary E. Elkins
*Attorney, Agent, or Firm*—Levy & Grandinetti

[57] ABSTRACT

A carton is formed from a blank of cardboard or paperboard by folding the blank along preformed score lines or fold lines. The carton has front and rear walls, opposite side walls, corner walls, and top and bottom walls defining an enclosure for receiving the contents. Tabs are attached to the top and bottom walls at the corners and are folded downward over the corner walls to prevent light from entering the space between the corner walls and the top and bottom walls. Slots can be provided in the corner walls, and the ends of the tabs inserted into the slots to retain the tabs in a flush position against the corner walls.

13 Claims, 3 Drawing Sheets

PAPERBOARD CARTON AND BLANK THEREFOR

I claim the benefit under Title 35, United States Code, § 120 U.S. Provisional Application No. 60/089,981, filed Jun. 19, 1998, entitled PAPERBOARD CARTON AND BLANK THEREFOR.

BACKGROUND OF THE INVENTION

1. Field of the Invention

The present invention is directed to a paperboard container or carton (hereinafter referred to, for brevity, simply as "carton") and to a blank for making the carton. More particularly, the invention relates to a carton formed from a folded blank which substantially prevents light from entering the carton.

2. Description of Related Art

Cartons are commonly used for packaging bottled and canned beverages for shipment and distribution to the ultimate customer. Most desirably, the carton is one that provides adequate protection to the product at the lowest possible cost without sacrificing strength. In the packaging and distribution of alcoholic beverages and other light-sensitive materials, the carton should provide adequate protection to the beverage from exposure to light. Generally, it is desirable to provide the carton to the manufacturer of the product being packaged in a compact, usually knocked-down, form. Moreover, the carton should be easy to assemble and erect for loading with the product.

Many cartons currently in use are of the top-loading type where the top wall of the carton is formed by a pair of end walls attached to side walls. The cartons are usually supplied to the manufacturer in a collapsed condition and then erected such that the top panels are in an open condition. After the product is placed in the carton, the top flaps or panels of the carton are folded to close it. An example of one such carton is disclosed generally in U.S. Pat. No. 4,367,840.

Generally, it is desirable to form the carton from a blank of cardboard or paperboard that has various fold lines to permit the blank to be folded into the proper shape. The blanks typically have a number of panels and glue tabs for assembling the carton. Some blanks, alternatively or in addition, have a number of slits and corresponding tabs that, when inserted into the slits, cause the carton to be retained in the desired shape. A disadvantage of many of these folded blanks is that they do not provide adequate protection from light entering the carton and striking the contents. When the packaged product is a light-sensitive one, such as beer, it is important to minimize the amount of light entering the carton in order to retard its spoilage rate.

Accordingly, there is continuing need in the industry for improved containers which can be easily formed from a blank while providing adequate protection to the product.

SUMMARY OF THE INVENTION

The present invention is directed to a carton and to a blank for forming the carton. More particularly, the invention relates to a folded blank for substantially completely enclosing a packaged product and providing adequate protection to the contents during shipping and handling.

Accordingly, it is a primary object of the present invention to provide a carton that encloses a packaged product and minimizes the amount of light striking the packaged product when the carton is closed.

Another object of the present invention is to provide a carton that is easy to manufacture and assemble from a blank and that can, if desired, be partially folded and shipped to a packaged goods manufacturer, where the carton can be filled and closed.

Still another object of the present invention is to provide a blank cut from a single sheet of material that can be folded easily into a carton having no substantial opening that would permit light to enter.

The carton of the present invention is formed from a blank, usually of paperboard, and has a top panel having first and second substantially parallel end edges, first and second substantially parallel side edges, and corner edges extending diagonally from each of the end edges to an adjacent side edge. In preferred embodiments, the end edges are shorter in length than the side edges. A first side wall is contiguous with the first side edge of the top panel, and a second side wall is contiguous with the second side edge of the top panel. Each of the first and second side walls has a top edge joined to the respective side edge of the top panel, a bottom edge parallel to the top edge, and opposite parallel side edges.

First and second end walls are coupled to the first and second end edges of the top panel, respectively, and extend downward substantially perpendicular to the top panel.

A side flap is coupled to each of the side edges of each side wall. Each of the side flaps has a side panel formed from the respective side edge of the side wall and a second side edge parallel to the side edge of the side wall. The side panel has a width substantially the length of the corner edge and extends downward from the corner edge and substantially perpendicular to the top panel. An end wall is joined to the side panel along the second side edge of the side panel and extends downward from the end edge of the top panel and substantially perpendicular to the top panel.

A bottom panel lies substantially parallel to the top panel and has first and second substantially parallel end edges, first and second substantially parallel side edges, and corner edges extending diagonally from each of the end edges to an adjacent side edge. The bottom panel is coupled to the first and second side walls along its first and second side edges. First and second bottom end flaps are coupled to the first and second end edges of the bottom panel, respectively, and extend upwardly substantially perpendicular to the bottom panel.

A trapezoidal tab member is coupled to each of the corner edges of the top panel and extends downward substantially perpendicular to the top panel and parallel to each side panel. Tab members may also be similarly coupled to the corner edges of the bottom panel, if desired. Each tab member has a first edge extending adjacent an edge of an end panel. The tab member substantially completely encloses a space between the corner edges and the side panels to prevent light from entering the carton. The end panels and the bottom flaps are coupled to the respective end walls.

The invention is further directed to a blank for forming a paperboard carton where the blank includes a bottom panel having first and second substantially parallel end edges, first and second substantially parallel side edges, and corner edges extending diagonally from each of the end edges to an adjacent side edge. The end edges are preferably shorter than the side edges.

A first side wall of the blank is connected to the first side edge of the bottom panel by a first fold line. A second side wall is connected to the second side edge of the bottom panel by a second fold line. Each of the first and second side walls has a first edge joined to the respective side edge of the bottom panel. Each side wall also has a second edge parallel to the first edge and opposite parallel side edges.

A side flap is coupled to each of the side edges of each side wall. The side flap has a side panel attached to the side edge of the side wall by a fold line. An end panel is attached to the side panel by a fold line. The side panel has a width substantially the length of the corner edge. A top panel is coupled to the second side wall by a fold line extending along the second edge of the second side wall. The top panel has first and second substantially parallel end edges, first and second substantially parallel side edges, and corner edges extending diagonally from each of said end edges to an adjacent side edge. First and second end flaps are coupled to the first and second end edges of the top panel, respectively, by fold lines.

First and second end flaps are coupled to the first and second side edges, respectively, of the bottom panel by fold lines. A tab is coupled to each of the corner edges of the top panel by a fold line. The tab has a first edge extending at an acute angle with respect to the side edge of the side panel.

These objects and other objects, advantages, and salient features of the invention will become apparent when taken in conjunction with the appended drawings of the invention and the following detailed description of the invention.

BRIEF DESCRIPTION OF THE DRAWINGS

This invention will now be described with reference to the accompanying drawings in which.

DESCRIPTION OF THE PREFERRED EMBODIMENTS

Figure 1:
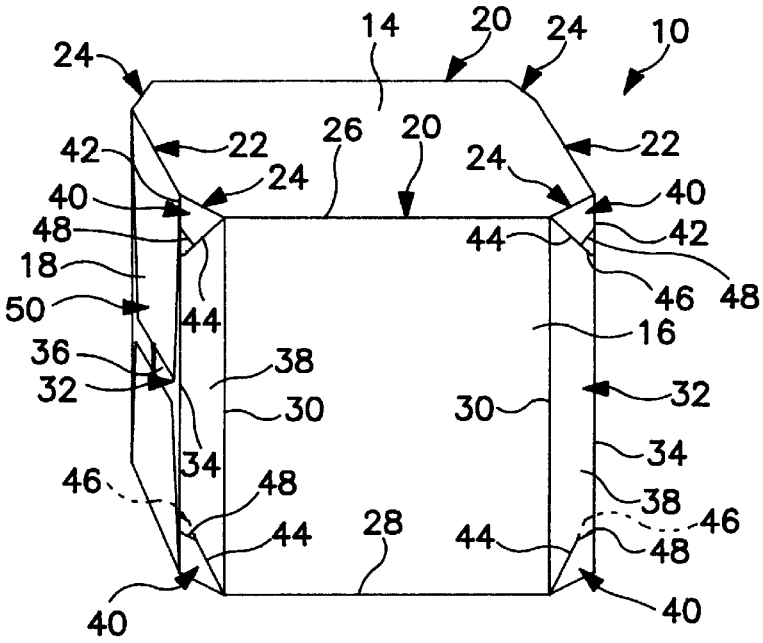
FIG. 1 is a perspective view of the carton in a preferred embodiment of the invention.
Figure 2:
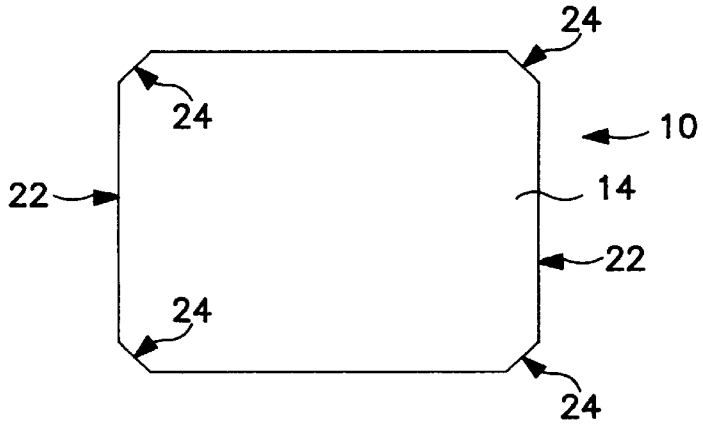
FIG. 2 is a top plan view of the carton of the embodiment of FIG. 1.
Figure 3:
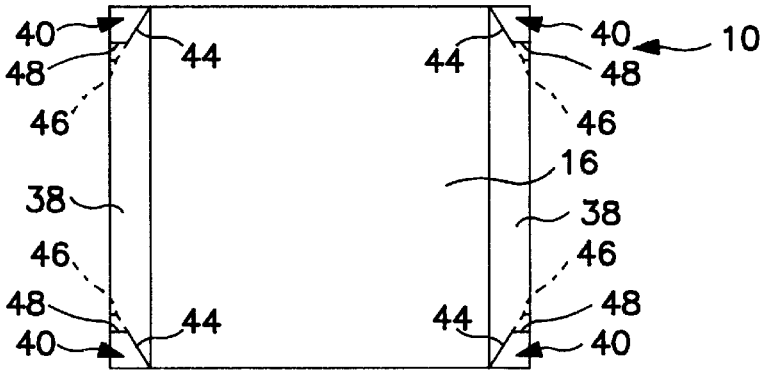
FIG. 3 is a side elevational view of the carton of the embodiment of FIG. 1.

The present invention is directed to a carton formed from a folded blank where the blank is folded in a manner substantially to prevent light from entering the carton and particularly to prevent light from entering at the corners of the carton. In this manner, the contents of the carton are protected from degradation by light, thereby increasing the shelf life of the contents.

Referring to FIGS. 1–4, the invention relates to a carton 10 formed from a folded blank 12. Carton 10 has a generally box-like shape having a top wall 14, a front wall 16, and opposite side walls 18. A rear wall and a bottom wall (not shown in FIG. 1) correspond generally to the front wall and top wall, respectively, in shape and size.

As shown in FIG. 1, top wall 14 has elongated front and rear edges 20, shorter side edges 22, and corner edges 24 extending diagonally from the side edges 22 to the front and rear edges 20 to form an eight-sided configuration. Front wall 16 is connected to top wall 14 by a fold line 26 and to the bottom wall by a fold line 28. Attached to front wall 16 by fold lines 30 are side flaps 32. Side flaps 32 include a fold line 34 to define an end panel 36 and a side panel 38. As shown in FIG. 1, side panel 38 extends substantially parallel to corner edge 24, and end panel 36 extends substantially parallel to side edge 22.

A tab 40 is attached to each of the corner edges 24 by a fold line and is folded downward substantially parallel to the side panel 38. In embodiments of the invention, tabs 40 are attached to each of the corner edges of the top wall and folded downward onto the side walls. In the embodiment illustrated, tabs 40 are also provided on each of the corner edges of the bottom wall of the carton and folded upward onto the side wall. In other embodiments, the tabs 40 are provided only on the top wall 14. The tabs 40 are substantially identical to one another, and each tab and its various features are identified by the same reference numeral.

Tab 40 has a first side edge 42 extending along the fold line which joins end panel 36 to side panel 38. A second side edge 44 of tab 40 extends diagonally toward an outer edge 46. A slot 48 is formed in the side panel 38 at a distance from the edge of the side panel which is less than the length of the tab 40. Tab 40 is folded along the outer face of side panel 38 in the embodiment shown and is inserted into slot 48 to hold the tab 40 in place. In this manner tab 40 is able to block substantially all of the light which would otherwise enter the carton through the gap between the side panel 38 and the corner edge 24 of top wall 14. In other embodiments, the tab 40 can be folded on the inside face of side panel 38 and then extended through the slot 48 so that the end of the tab 40 extends outward through the slot 48.

End walls 50 are attached to the top wall 14 along the side edges 22 and folded downward over the end panels 36. In preferred embodiments of the invention, the end walls 50 are attached to the end panels 36 by a suitable adhesive to form the side walls 18.

Figure 4:
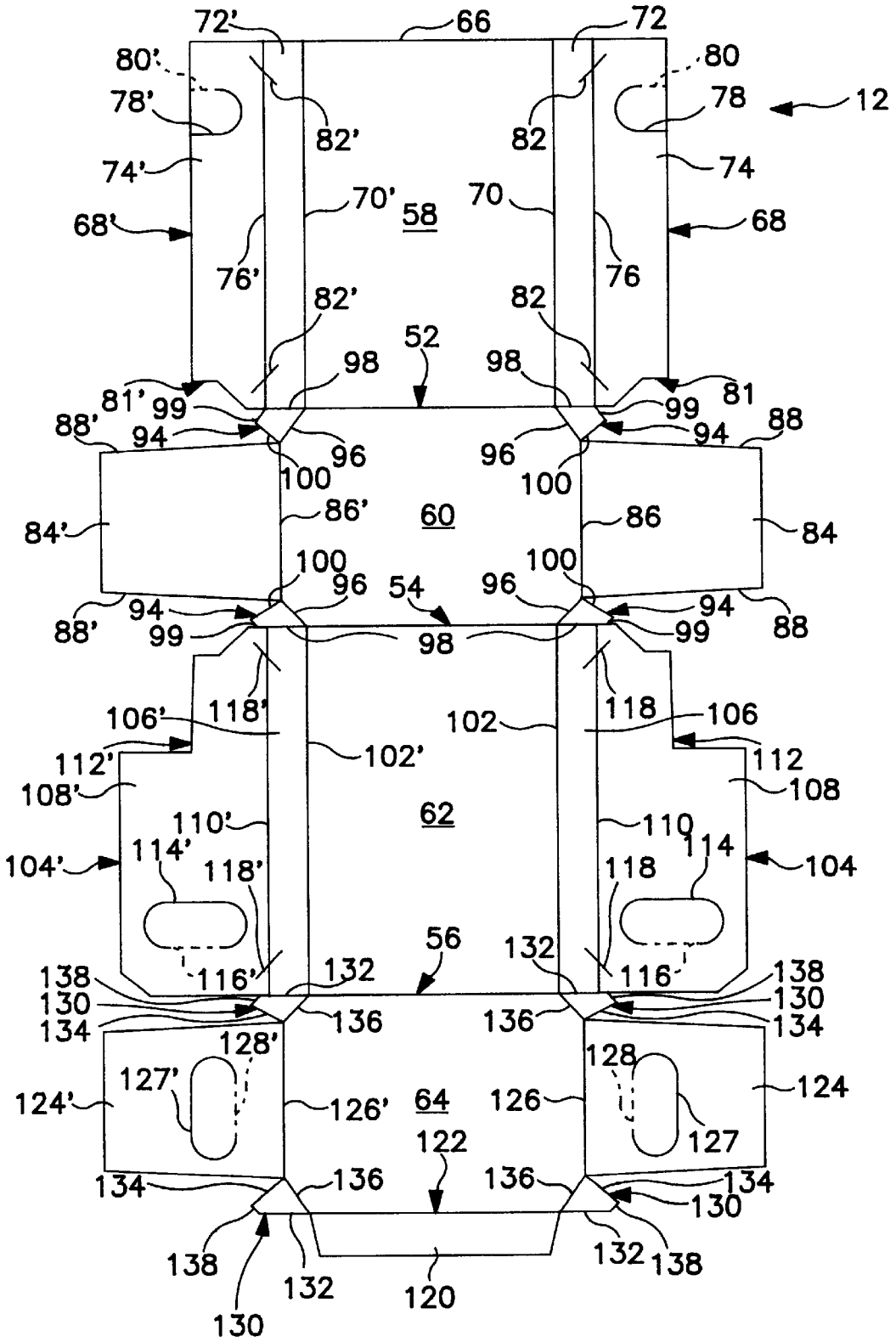
FIG. 4 is a top plan view of the blank for forming the carton of the embodiment of FIG. 1.

The carton 10 is produced from the blank 12 as shown in FIG. 4. The blank 12 is generally made from a suitable sheet material, such as cardboard or paperboard. In preferred embodiments of the invention the blank is cut from a single sheet of material by conventional cutting devices.

Blank 12 has a substantially planar shape and is formed into a plurality of panels, tabs, and walls by a plurality of fold lines as shown in FIG. 4 and as discussed in greater detail hereinafter. The fold lines or score lines are formed into the sheet material using standard apparatus to define lines of weakness for folding the blank into its final form as a carton as shown in FIG. 1. Specifically, blank 12 is divided by transverse fold lines 52, 54 and 56 to define a first side wall 58, a bottom panel 60, a second side wall 62, and a top panel 64, respectively.

The first side wall 58 has a substantially rectangular shape in the embodiment shown with a first transverse edge 66 and a second transverse edge formed by fold line 52. Side flaps 68 and 68' are attached to the first side wall 58 along longitudinal fold lines 70 and 70'. The side flaps 68 and 68' are divided into corner panels 72 and 72' and end panels 74 and 74' by longitudinal fold lines 76 and 76'. The end panels 74 and 74' have a curved cut line 78 and 78' and fold line 80 and 80' for forming a hand hold. The corners of the end panels 74 and 74' have a notched portion 81 and 81' cut from the blank 12 to assist in folding and forming the completed carton. At least two slots 82 and 82' are cut into the blank 12 across longitudinal fold lines 76 and 76', respectively.

As shown in FIG. 4, two slots 82 and 82' are cut into longitudinal fold lines 76 and 76', respectively, adjacent the transverse edges of the first side wall 58. In preferred embodiments of the invention, the slots 82 and 82' are cut at about a 40 degree angle with respect to the longitudinal fold lines 76 and 76' and extend in an inward direction from the transverse edges of the first side wall 58 toward the middle of the first side wall 58.

The bottom panel 60 is attached to the first side wall 58 by the fold line 52 and to the second side wall 62 by fold line 54 to define transverse edges. End wall panels 84 and 84' are attached to the opposite side edges of the bottom panel 60, defined by fold lines 86 and 86'. In the embodiment shown, end wall panels 84 and 84' have tapered side edges 88 and 88' that have a length of about one half the longitudinal dimension of the first side wall 58.

In the embodiment shown, bottom panel 60 has tabs 94 attached thereto by diagonal fold lines 96. Bottom panel 60 has an eight-sided configuration defined by the diagonal fold lines 96 with the diagonal fold lines 96 forming diagonal corners. The tabs 94 and the features of the tabs attached to each corner are substantially the same and are identified by the same reference numbers. The tabs 94 are defined by the diagonal fold lines 96 and have first edges 98 parallel to the transverse edges of the bottom panel 60; second edges 100 extending diagonally with respect to the longitudinal and transverse edge of the bottom panel 60; and outer edges 99 extending between the first edges 98 and second edges 100 whereby the tabs 94 have a substantially trapezoidal shape. In preferred embodiments, second edge 100 extends at an angle of about 40 degrees with respect to the transverse fold lines 52 and 54.

The second side wall 62 is substantially the same as the first side wall 58. The second side wall 62 is defined by longitudinal fold lines 102 and 102' and transverse fold lines 54 and 56. Side flaps 104 and 104' are connected to the second side wall 62 by the longitudinal fold lines 102 and 102'. The side flaps 104 and 104' are divided into corner panels 106 and 106' and end panels 108 and 108' by fold lines 110 and 110'.

End panels 108 and 108', at their widest points, have a width substantially equal to the length of the fold lines 86 and 86' and have a stepped portion 112 and 112' cut adjacent the bottom panel 60. Curved cut portions 114 and 114' and fold lines 116 and 116' are provided in the end panels 108 and 108' to define hand holds. Slots 118 and 118' are formed across fold lines 110 and 110' in the same manner as slots 82 and 82' in the first side wall 58.

The top panel 64 is dimensioned substantially the same as the bottom panel 60 and is attached to the second side wall 62 by the fold line 56. A glue tab 120 is attached to the top panel 64 along the transverse edge opposite the fold line 56 by a fold line 122. End wall panels 124 and 124' are attached to the top panel 64 on opposite sides by longitudinal fold lines 126 and 126'. The end wall panels 124 and 124' are substantially the same size as the end wall panels 84 and 84' attached to the bottom panel 60. Each of the end wall panels 124 and 124' is provided with a curved cut portion 127 and 127' and a fold line 128 and 128' to define a hand hold.

Tabs 130 are attached to each of the corners of the top panel 64 and have a first edge 132 extending parallel to the fold line 122 and fold line 56 and a second edge 134 extending diagonally with respect to the longitudinal and the transverse fold lines, in the same manner as described above for the corresponding aspects of tabs 94 attached to the bottom panel 60. Tabs 130 are connected to top panel 64 by diagonal fold lines 136 which extend diagonally from longitudinal fold lines 126 and 126' to the fold line 56 and fold line 122 so that the top panel 64 has an eight-sided configuration with the diagonal fold lines 136 forming diagonal corners. Tabs 130 have a truncated edge 138 whereby tabs 130 have a substantially trapezoidal shape.

The blank 12 as shown in FIG. 4 is used to form the carton 10 by first folding the blank 12 along the transverse fold lines. The glue tab 120 is attached to the inner surface of the first side wall 58 so that the fold line 122 of the glue tab 120 is adjacent to the first transverse edge 66 of the first side wall 58. At this point, the partially assembled blank has a rectangular configuration with the ends open. The partially assembled blank 12 can be folded flat along at least two of the fold lines to assume a collapsed configuration. The partially assembled blank 12 is then shipped to the manufacturer where the blank 12 is opened to form an open-ended carton.

The partially folded blank 12 can then be filled with desired contents and the side flaps 68, 68', 104, and 104' folded inward. The side flaps 68, 68', 104, and 104' are preferably folded so that the corner panels 72, 72', 106, and 106' are adjacent the corners of the top and bottom panels 64 and 60, respectively, and the end panels 74, 74', 108, and 108' are adjacent the edges of the top and bottom panels. The end wall panels 84, 84', 108, and 108' are then folded onto the folded side flaps 68, 68', 104, and 104' and attached thereto by means of a suitable adhesive. The tabs 94 and 130 attached to the corners of the top and bottom panels are then folded along diagonal fold lines 96 and 136 and inserted into the slots 82, 82', 118, and 118' formed in side flaps 68, 68', 104, and 104' to form a carton substantially as shown in FIG. 1. The cut and fold lines which form the hand holds are preferably retained in the unfolded position so as to block light from entering the carton during storage. The cut portions of the hand holds can be pushed inward to provide a handle for lifting the carton. The cut portions in the end panels 74, 74', 108, and 108' and the end wall panels 124 and 124' are preferably designed so that when the blank is folded the cut portions are aligned with one another and can be folded inward simultaneously.

Figure 5:
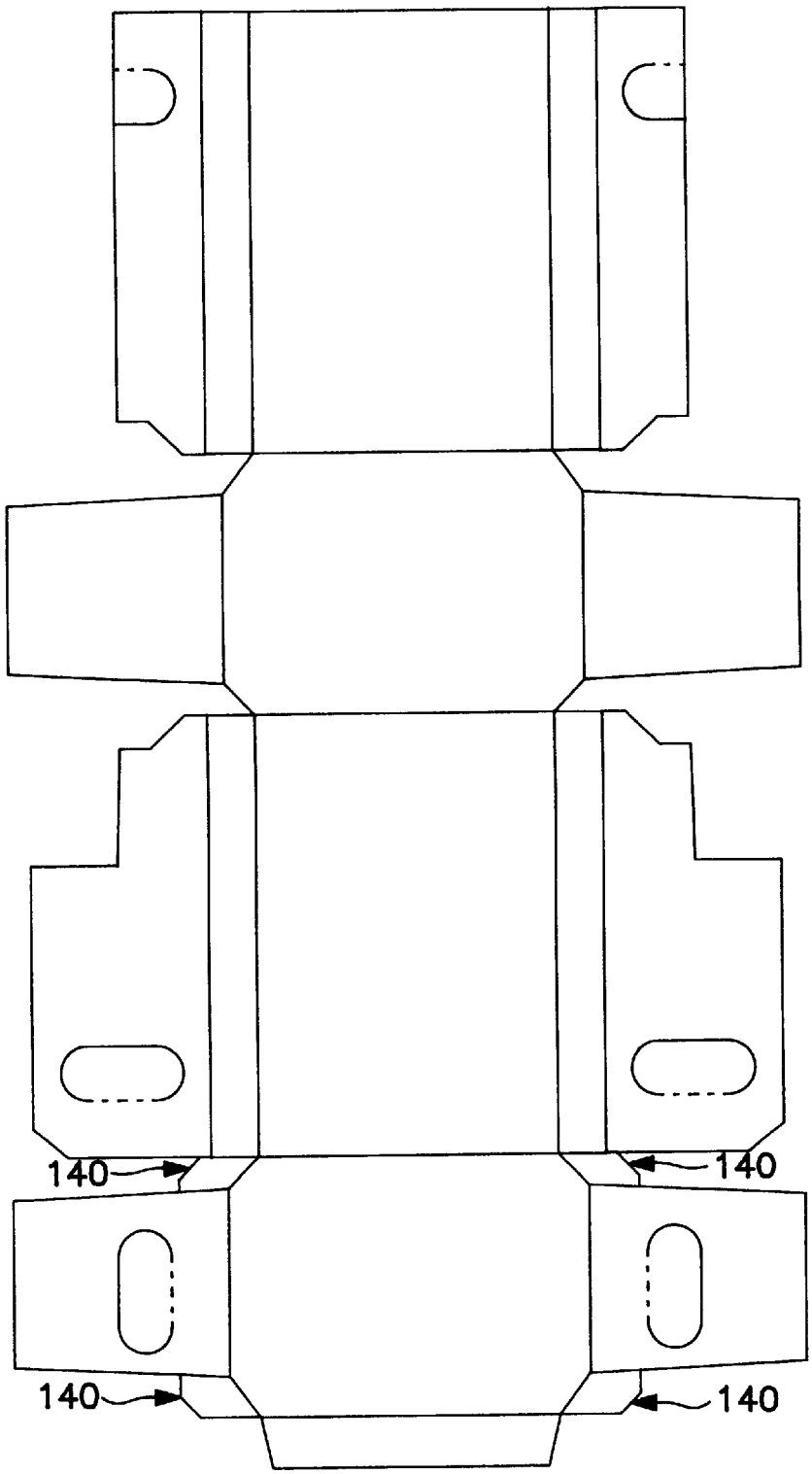
FIG. 5 PRIOR ART
FIG. 5 is a top plan view of a blank for forming a carton of the prior art.

FIG. 5 depicts a blank used for forming a carton of the prior art. This blank is identical to the blank of FIG. 4 with the following exceptions:

1. The blank of FIG. 5 has no tabs corresponding to tabs 94 of FIG. 4;
2. The blank of FIG. 5 has no slots corresponding to slots 82, 82', 118, and 118' of FIG. 4; and
3. The shape of tabs 140 of FIG. 5, which has five sides and is substantially a parallelogram having one acute vertex truncated, is significantly different from the shape of tabs 94 and 130 of FIG. 4, which is four-sided and trapezoidal.

The carton of the present invention is thus an improvement over the prior art carton depicted in FIG. 5. It is substantially easier for the manufacturer of the contents to load the contents into the carton of the present invention and then close the cover than was the case when the carton of the prior art of FIG. 5 was used. This is especially so when the preferred embodiment of the invention is employed, wherein slots are provided to receive the tabs. In this case, it is easier to engage the tabs into the slots from the outside of the carton than it is to tuck them inside the carton, as was required previously.

While certain embodiments of the invention have been selected to illustrate the carton and blank, it will be apparent to one of ordinary skill in the art that various other embodiments can be produced without departing from the scope of the invention as defined the appended claims.

What is claimed is:

1. A carton formed from a blank, said carton comprising:

a top panel having first and second substantially parallel end edges, first and second substantially parallel side edges, and corner edges extending diagonally from each of said end edges to an adjacent side edge;

a first side wall contiguous with said first side edge of said top panel and a second side wall contiguous with said second side edge of said top panel, each of said first and second side walls having a top edge joined to said respective side edge of said top panel, a bottom edge parallel to said top edge, and opposite parallel side edges;

a side flap coupled to each of said side edges of each side wall, said side flap having a side panel formed from said respective side edge of said side wall and a second side edge parallel to said side edge of said side wall, said side panel having a width substantially the length of said corner edge and extending downward from the corner edge and substantially perpendicular to the top panel, and an end wall joined to said side panel along the second side edge of the side panel and extending downward from the end edge of said top panel and substantially perpendicular to said top panel;

a bottom panel lying substantially parallel to said top panel and being coupled to said first and second side walls along first and second side edges;

first and second end walls coupled to said first and second end edges of said top panel, respectively, and extending downward substantially perpendicular to said top panel;

first and second bottom end flaps coupled to said first and second end edges, respectively, and extending upwardly substantially perpendicular to said bottom panel; and a trapezoidal tab member coupled to each of said corner edges of the top panel and extending downward substantially perpendicular to said top panel and parallel to said side panel, said tab member having a first edge extending adjacent to an edge of said end panel, wherein said tab member encloses a space between said corner edges and said side panels to prevent light from entering said carton; and wherein said end panels and said bottom flaps are coupled to said respective end walls.

2. The carton of claim 1, wherein each of said tabs has an outer edge substantially perpendicular to said first edge and a second side edge forming an acute angle with respect to said first edge.

3. The carton of claim 1, wherein said side panel includes a slot and said tab extends through said slot.

4. The carton of claim 3, wherein said slot extends at about a 40 degree angle with respect to the side edge of said side panel.

5. The carton of claim 1, wherein said end walls include a frangible line defining a handle opening for lifting said carton.

6. The carton of claim 1, further comprising a glue flap coupled to said bottom panel and attached to said first side wall.

7. The carton of claim 1, wherein said tab has a length less than said side panel.

8. A blank for forming a carton, said blank comprising:

a bottom panel having first and second substantially parallel end edges, first and second substantially parallel side edges, and corner edges extending diagonally from each of said end edges to an adjacent side edge;

a first side wall connected to said first side edge of said bottom panel by a first fold line, and a second side wall connected to said second side edge of said bottom panel by a second fold line, each of said first and second side walls having a first edge joined to said respective side edge of said bottom panel, a second edge parallel to said first edge, and opposite parallel side edges;

a side flap coupled to each of said side edges of each side wall, said side flap having a side panel attached to said side edge of said side wall by a fold line, and an end panel attached to said side panel by a fold line, said side panel having a width substantially the length of said corner edge;

a top panel coupled to said second side wall by a fold line extending along said second edge of said second side wall; said top panel having first and second substantially parallel end edges, first and second substantially parallel side edges, and corner edges extending diagonally from each of said end edges to an adjacent side edge;

first and second end flaps coupled to said first and second end edges of said top panel, respectively, by fold lines;

first and second end flaps coupled to said first and second side edges, respectively, of said bottom panel by fold lines; and a trapezoidal tab coupled to each of said corner edges of said top panel by fold lines, said tab having a first edge extending at an acute angle with respect to said side edge of said side panel.

9. The blank of claim 8, wherein each of said tabs has an outer edge substantially perpendicular to said first edge of said tab and wherein said first edge of said tab extends substantially parallel to said fold line coupling said tab to said corner edges.

10. The blank of claim 8, wherein said end walls further include frangible lines defining handle openings.

11. The blank of claim 8, further comprising a glue flap coupled to said top panel by a fold line.

12. The blank of claim 9, further comprising a slot in said side panel for receiving said tab when said blank is in a folded configuration.

13. The blank of claim 12, wherein said slot extends at about a 40 degree angle with respect to said side edge of said side panel.

* * * * *